US010757968B1

(12) United States Patent
Siefert et al.

(10) Patent No.: US 10,757,968 B1
(45) Date of Patent: Sep. 1, 2020

(54) FLOATING SMOKING DEVICE

(71) Applicants: Nevin R. Siefert, Brooksville, FL (US); Terry Ray Sapp, Springhill, FL (US)

(72) Inventors: Nevin R. Siefert, Brooksville, FL (US); Terry Ray Sapp, Springhill, FL (US)

( * ) Notice: Subject to any disclaimer, the term of this patent is extended or adjusted under 35 U.S.C. 154(b) by 0 days.

(21) Appl. No.: 15/961,280

(22) Filed: Apr. 24, 2018

(51) Int. Cl.
*A24F 1/30* (2006.01)

(52) U.S. Cl.
CPC ..... *A24F 1/30* (2013.01)

(58) Field of Classification Search
CPC ..... A24F 1/30; A24F 1/02; A24F 9/14; H04R 1/028; H04R 2420/07
See application file for complete search history.

(56) References Cited

U.S. PATENT DOCUMENTS 10,039,319 B2 * 8/2018 Sawalha ..... A24F 47/002
2010/0212679 A1 * 8/2010 Bishara ..... A24F 1/30 131/173
2013/0146070 A1 * 6/2013 Ross ..... A24F 1/30 131/173
2015/0181931 A1 * 7/2015 Hoover ..... A24F 1/30 131/260
2016/0165951 A1 * 6/2016 Gupta ..... A24F 1/30 131/329
2017/0251717 A1 9/2017 Mehio
2017/0290366 A1 * 10/2017 Dipsiner ..... A24F 1/30
2017/0347702 A1 * 12/2017 Bilikian ..... A24F 1/30
2018/0027872 A1 * 2/2018 Galaviz, Jr. ..... A24F 7/02
2018/0296776 A1 * 10/2018 Yener ..... A24F 1/30

* cited by examiner

*Primary Examiner* — Michael H. Wilson
*Assistant Examiner* — Jennifer A Kessie
(74) *Attorney, Agent, or Firm* — Sanchelima & Associates, P.A.; Christian Sanchelima; Jesus Sanchelima

(57) ABSTRACT

A smoking device that can float on water is disclosed. The smoking device comprises a base and an elongated pipe coupled to the base. The base comprises a floating ring to allow the smoking device to float on the water. The elongated pipe comprises one or more tubes. The tube is used to inhale smoke from a smoking material. The base comprising a plurality of floats to allow the smoking device to float on water is also disclosed.

7 Claims, 2 Drawing Sheets

FLOATING SMOKING DEVICE

BACKGROUND OF THE INVENTION

1. Field of the Invention

The present disclosure relates to a smoking device. More particularly, the present disclosure relates to hookah-based smoking device that can float on water.

2. Description of the Related Art

It is very well known that hookah or a water pipe is a smoking device utilized for smoking various smoking materials such as tobacco. Use of a hookah typically requires a person to manually handle and load a ceramic or fruit hookah bowl with the smoking material. After loading the smoking material in the bowl, a separate piece of perforated tin foil or a metal screen is placed above the smoking material and lit or hot coals are placed thereon. Smoke from the smoking material is bubbled through a liquid and is subsequently inhaled through one or more tubes.

Several designs of the hookah are proposed in the past. For example, United States Patent Application 20170251717 and U.S. Pat. No. 8,001,978 disclose different designs of the hookah.

Although the above patent applications disclose different designs of the hookah, the above disclosures have several disadvantages. As specified above, hookah is used by a group of people at a time. It is non-hygienic when people in groups use hookah by transferring the pipe from mouth to mouth. There are many people that do not want to smoke from a water pipe that was used by other people.

Further, the above designs cannot be used at places such as swimming pool, bathtub and so on, as the hookah based on above designs must be kept on a hard surface such as ground or on a table.

Other documents describing the closest subject matter provide for a number of more or less complicated features that fail to solve the problem in an efficient and economical way. None of the patents suggest the novel features of the present invention.

Therefore, there is a need for a smoking device that can float on water and has multiple tubes or pipes that can be used by different users to inhale smoke from the smoking material or the hookah.

SUMMARY OF THE INVENTION

It is one of the main objects of the present invention to provide a smoking device that can float on water that avoids the drawbacks of the prior art.

It is one object of the present invention to provide a smoking device comprising multiple tubes that can be used by different users simultaneously to inhale smoke from the smoking material.

It is another object to provide a smoking device comprising a base and an elongated pipe coupled to the base. The base comprises a floating ring to allow the smoking device to float on the water. The elongated pipe comprises one or more tubes. Each of the tubes may be used by users in order to inhale smoke from the smoking material.

It is another object to provide a smoking device comprising a base and an elongated pipe coupled to the base. The smoking device comprises a plurality of floats placed on water such that the smoking device is made to float on the water. The elongated pipe comprises one or more tubes. Each of the tubes may be used by users to inhale smoke from the smoking material.

It is another object to provide a plurality of chambers for holding different flavors of hookah such that each tube is coupled to an individual chamber to provide different flavors of the smoke.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE INVENTION

The following detailed description is intended to provide example implementations to one of ordinary skill in the art, and is not intended to limit the invention to the explicit disclosure, as one or ordinary skill in the art will understand that variations can be substituted that are within the scope of the invention as described.

The present disclosure discloses a smoking device that can float on water. The smoking device comprises a base and an elongated pipe coupled to the base. The base comprises a floating ring facilitating the smoking device to float on the water. The elongated pipe comprises one or more tubes. Each of the tubes is used by a user to inhale smoke from a smoking material.

In another embodiment, the base comprises a plurality of floats provided on water, which is used to place the base of the smoking device, in order to allow the smoking device to float on water.

Figure 1:
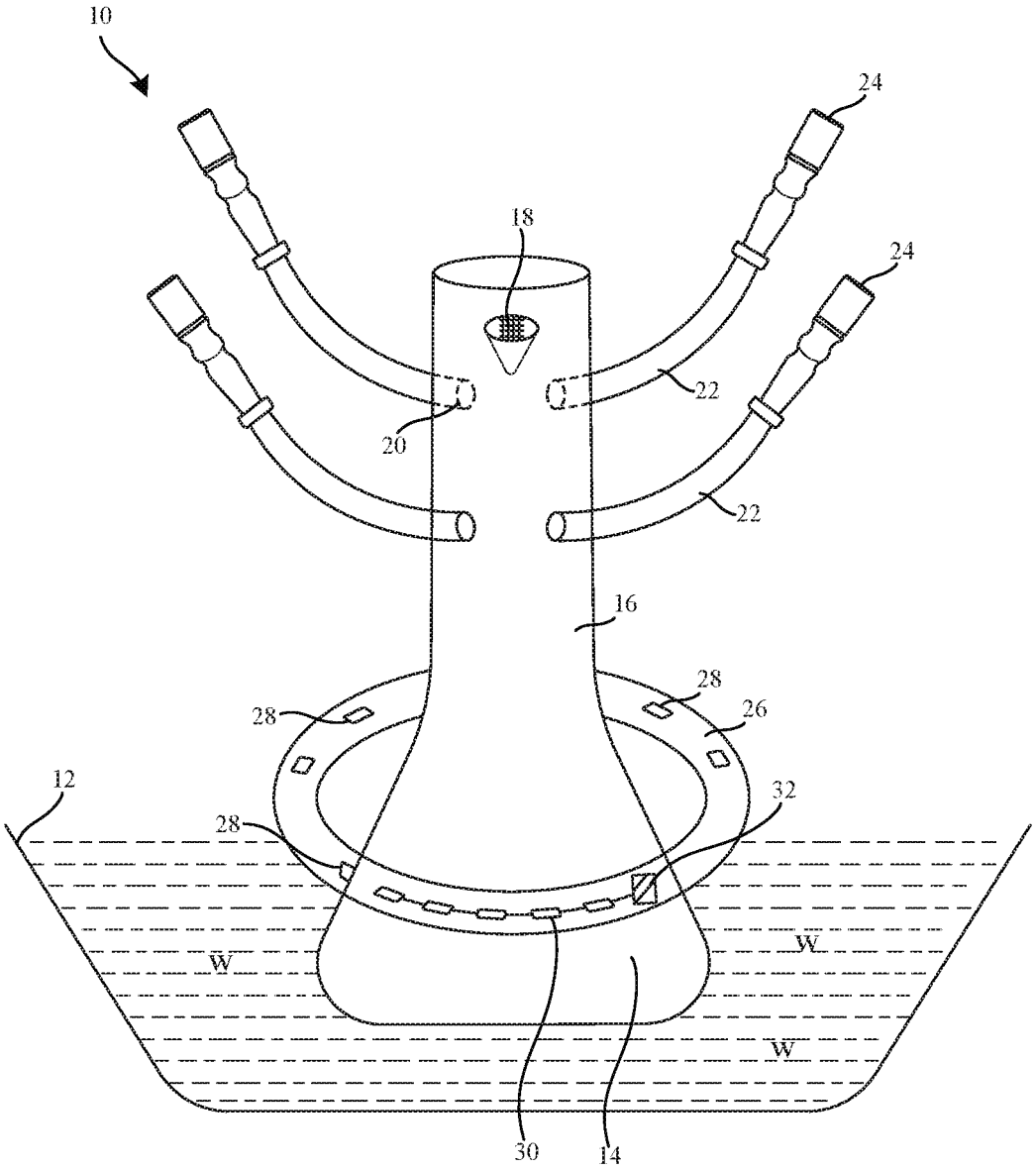
FIG. 1 illustrates a smoking device that can float on water comprising a floating ring, in accordance with one embodiment of the present disclosure.
Figure 2:
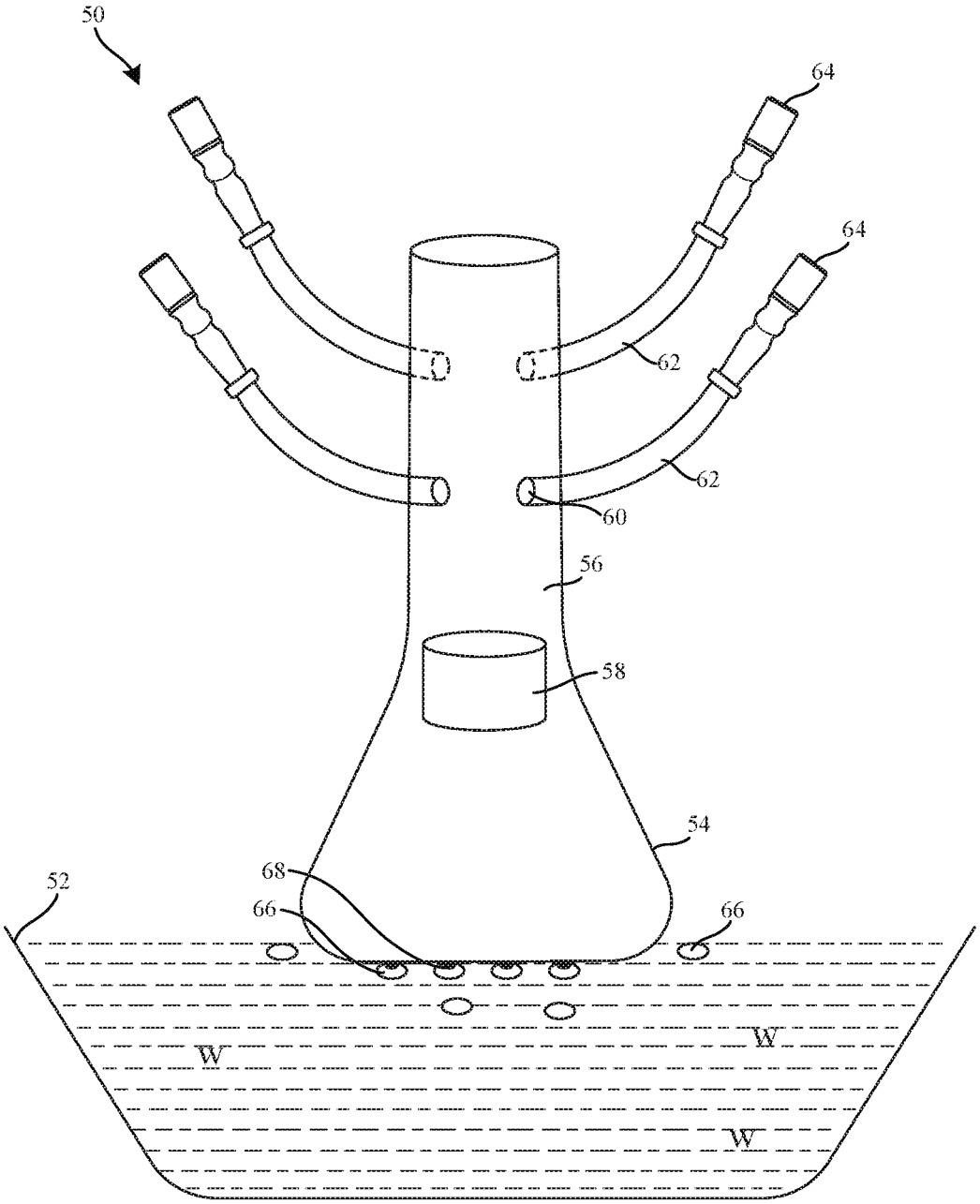
FIG. 2 illustrates a smoking device floating on water with the help of floats, in accordance with one embodiment of the present disclosure.

Various features and embodiments of the smoking device are explained in conjunction with the description of FIGS. 1-2.

Referring to FIG. 1, a smoking device 10 that can float on water is shown, in accordance with one embodiment of present disclosure. The smoking device 10 comprises a container 12. The container 12 may include a tub, a swimming pool, and so on. The container 12 may be filled with liquid such as water W. The smoking device 10 comprises a base 14 and an elongated pipe or stem or hookah pipe 16 coupled to the base 14. The base 14 may be provided in a bottle-like structure. The elongated pipe 16 may be provided in generally cylindrical shaped structure. In one example, the elongated pipe 16 may be provided in curved or non-cylindrical shaped structure. In one example, the base 14 and the elongated pipe 16 may be made up of any suitable material such as glass, plastic, acrylic, ceramic and so on. It should be understood that the base 14 and the elongated pipe 16 may be provided as a single component or as two separate components which may be operatively coupled so that lower end of the elongated pipe 16 is seated on a collar/upper portion (not shown) of the base 14.

The elongated pipe 16 may comprise a burner cup 18 for holding a smoking material, such as tobacco. In one example, the elongated pipe 16 may further comprise a plate (not shown) placed beneath the burner cup 18 for catching ashes and other materials from the burner cup 18. The smoking device 10 further comprises a plurality of holes 20 provided at the elongated pipe 16. In one implementation, each of the plurality of holes 20 may be provided with a tube 22, as shown in FIG. 1. The tube 22 may comprises a flexible tube in which length of tube 22 extends when the tube 22 is pulled.

As can be seen, one end of the tube 22 is coupled to the hole 20 and another end is provided with a pen 24 which can be used to inhale the smoke of the smoking material. As known, users may use different smoking material to obtain different flavor or aroma of the smoke. As such, the users may place the smoking material on the burner cup 18 and use the tube 22 to inhale the smoke (flavor) of the smoking material.

It should be understood two or more holes 20 might be provided at the elongated pipe 16 such that two or more users may inhale the smoke through the tubes 22 simultaneously. Further, the shape and size of the tubes 22 shown in the present disclosure is provided for illustration purpose only and should not be construed in limited sense.

In one embodiment, the smoking device 10 comprises a floating ring 26 coupled to the base 14. The floating ring 26 may be made up of rubber or synthetic material. The floating ring 26 of appropriate size may be chosen such that the floating ring 26 can take weight of the base 14 and the elongated pipe 16. Further, due to the structure of the floating ring 26, the elongated pipe 16 may be bent up to 45 degrees with respect to the surface of the water W such that users may use the smoking device 10 by pulling each of the tubes 22 at varied length and without tripping off the smoking device 10. It must be understood that the floating ring 26 facilitates in keeping the base 14 and the elongated pipe 16 afloat on surface of the water W at all times. In one implementation, the floating ring 26 is coupled to the base 14 using clips 28 or other known mechanisms (e.g., fastened or glued) to attach two components that are known in the art.

It should be noted the clips 28 might be used to place the pens 24 when the pens 24 are not in use. In other words, the pens 24 are placed on the clips 28. When the user wishes to smoke, the user may take the pen 24 out of the clip 28, and use the pen 24 to inhale the smoke from the smoking material. After inhaling, the user may put back the pen 24 in the clip 28. As such, the pens 24 are kept out of water W even when the smoking device 10 is kept in the swimming pool or in bathtub.

In one exemplary embodiment, the floating ring 26 may be provided with a plurality of illuminating devices 30, such as Light Emitting Diodes (LEDs). The illuminating devices 30 may be provided in variety of sizes or colors as may be needed to provide light across the smoking device 10. In order to light the illuminating devices 30, a battery 32 may be provided on the floating ring 26.

It should be understood that the position of the illuminating devices 30 as shown is provided for illustration purposes only and it should be obvious to a person skilled to the art to place the illuminating devices 30 on the base 14 to provide light around the smoking device 10.

Referring to FIG. 2, a smoking device 50 that can float on water is shown, in accordance with an alternate embodiment of the present disclosure. In the current embodiment, the smoking device 50 comprises a container 52 (similar to container 12). The container 52 may be filled with liquid such as water W. The smoking device 50 comprises a base 54 and an elongated pipe or stem or hookah pipe 56 coupled to the base 54.

The elongated pipe 56 may comprise a tank 58 for storing an electronic juice or vaporization. The tank 58 may be refilled as required. In one example, the elongated pipe 56 may further comprise an atomizer (not shown) used to heat and vaporize the electronic juice. In order to heat the electronic juice, battery coils (not shown) may be provided at the base 54. The smoking device 50 further comprises a plurality of holes 60 provided at the elongated pipe 56. In one implementation, each of the plurality of holes 60 may be provided with a tube 62, as shown in FIG. 2. As can be seen, one end of the tube 62 is coupled to the hole 60 and another end is provided with a pen 64 which can be used to inhale the smoke or vapor of the electronic juice.

In the current embodiment, the smoking device 50 comprises a plurality of floats 66 coupled to the base 54. The floats 66 may be made up of rubber or synthetic material and has properties to float on water. The floats 66 are placed at appropriate distance from each other such that the base 54 of the smoking device 50 can be placed on the floats 66. In other words, the floats 66 facilitates in keeping the base 54 and the elongated pipe 56 afloat on surface of the water W at all times. In one implementation, the floating ring 66 is coupled to the base 54 using clips 68.

As explained earlier, the smoking device 50 may be provided with a plurality of illuminating devices (not shown, similar to illuminating devices 30 shown in FIG. 1), such as Light Emitting Diodes (LEDs) on the base 54 to provide light around the smoking device 50. The illuminating devices may be provided in variety of colors as may be needed to provide light across the smoking device 50. In order to light the illuminating devices, a battery (not shown) may be provided on the base 54.

It should be understood that users may use the smoking device explained above while in the swimming pool or in the bathtub. Further, one or more users may inhale the smoke from the smoking material simultaneously with the help of the tubes provided on the elongated tubes.

The smoking device may be rotated using the floating ring in order to inhale different flavors of the smoke from different tubes/pens. Two or more users may use the smoking device simultaneously at swimming pool or bathtub while maintaining hygiene. Further, the illuminating devices may be used to provide light and the smoking device may be used even at the nights.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A floating smoking device, comprising:

a. an elongated pipe assembly having and upper end and a lower end defining a base, said elongated pipe assembly further including a plurality of through holes each having a corresponding connecting tube and a distal end with a pen mounted thereon for a user to smoke frame each of said corresponding connecting tube, and further including a burner cup to hold a predetermined amount of smokable material and said burner cup being connected with the interior of said pipe, said burner cup having a conical shape; and b. a floating ring assembly coaxially and externally mounted to said elongated pipe assembly at a predetermined distance above said base and below said plurality of through holes so that a portion next to said base is immersed in a body of water causing said pipe assembly to float keeping said plurality of holes above a water level of said body of water, wherein said base is located entirely below said floating ring assembly, said floating ring assembly further including a plurality of battery operated illuminating devices mounted thereon for illuminating said smoking device, and a plurality of clips corresponding to a plurality of pens of said elongated pipe assembly to support said plurality of pens when not in use, wherein said plurality of clips are located on an outer surface of said floating ring assembly, wherein said plurality of pens are mounted on said plurality of clips.

2. A floating smoking device, comprising:

a. An elongated pipe assembly having an upper end and a lower end defining a base, said elongated pipe assembly further including a plurality of through holes each having a corresponding connecting tube and a distal end with a pen mounted thereon for a user to smoke from each of said tubes, and further including a burner cup to hold a predetermined amount of smokable material and said burner cup being connected with an interior of said elongated pipe assembly, said elongated pipe assembly further including a tank storing an electronic juice or vaporization, wherein said tank is placed within said elongated pipe assembly between said upper end and said lower end, said tank having a cylindrical shape; and b. A plurality of float members floating in a body of water supporting said elongated pipe assembly, wherein said plurality of float members are located entirely beneath said base, said plurality of floats being made of a rubber or synthetic material configured to have properties to float on water, wherein said plurality of float members are spaced part along said base.

3. The floating smoking device set forth in claim 2 wherein said float members further include a corresponding plurality of float member mounting clips for mounting said floating members to said base.

4. The floating smoking device set forth in claim 2 wherein said float members are coupled to a bottom most end of said base.

5. The floating smoking device set forth in claim 1, wherein said corresponding connecting tubes are located beneath said burner cup along a neck portion of said elongated pipe assembly.

6. The floating smoking device set forth in claim 1 wherein said upper end includes a diameter less than a diameter of said lower end.

7. The floating smoking device set forth in claim 2 wherein said tank is located beneath said corresponding connecting tubes and above said base.

* * * * *